US006263948B1

(12) United States Patent
Whitley

(10) Patent No.: US 6,263,948 B1
(45) Date of Patent: Jul. 24, 2001

(54) BOTTOM BRACKET FOR UPWARD ACTING DOOR

(75) Inventor: L. Blake Whitley, Arlington, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 09/552,492

(22) Filed: Apr. 19, 2000

(51) Int. Cl.[7] ..... E05D 15/06
(52) U.S. Cl. ..... 160/201; 160/193
(58) Field of Search ..... 160/201, 207, 160/209, 229.1, 193; 16/97, 102, DIG. 1, DIG. 20

(56) References Cited

U.S. PATENT DOCUMENTS

| | | | | |
|---|---|---|---|---|
| 1,285,285 | | 11/1918 | McCloud . | |
| 1,629,973 | | 5/1927 | Rush et al. . | |
| 1,709,872 | | 4/1929 | Peelle . | |
| 1,724,995 | | 8/1929 | Dautrick . | |
| 2,083,467 | * | 6/1937 | Morris | 160/201 X |
| 2,093,020 | | 9/1937 | Norberg . | |
| 2,291,583 | * | 7/1942 | Rowe | 160/201 X |
| 2,525,309 | | 10/1950 | Norberg . | |
| 2,538,626 | | 1/1951 | Olsen . | |
| 2,694,214 | | 11/1954 | Hammer . | |
| 2,703,141 | | 3/1955 | McKee . | |
| 2,916,089 | * | 12/1959 | D'Orazio | 160/201 |
| 3,023,804 | * | 3/1962 | Howell | 160/201 X |
| 3,160,200 | | 12/1964 | McKee et al. . | |
| 3,258,062 | | 6/1966 | Lambert . | |
| 3,412,780 | | 11/1968 | Moler . | |
| 3,416,589 | | 12/1968 | Lambein . | |
| 3,757,845 | | 9/1973 | Pagliaro . | |
| 3,785,090 | | 1/1974 | MacGillis . | |
| 4,120,072 | | 10/1978 | Hormann . | |
| 4,379,479 | | 4/1983 | Whiting . | |
| 4,472,910 | | 9/1984 | Iha . | |
| 5,053,263 | | 10/1991 | Bies . | |
| 5,103,890 | | 4/1992 | Cloutier . | |
| 5,353,473 | | 10/1994 | Sherick . | |
| 5,404,927 | | 4/1995 | Bailey . | |
| 5,495,640 | | 3/1996 | Mullet et al. . | |
| 5,706,877 | | 1/1998 | Grisham et al. . | |
| 5,918,660 | * | 7/1999 | Crawford et al. | 160/201 |

* cited by examiner

*Primary Examiner*—David M. Purol
(74) *Attorney, Agent, or Firm*—Akin, Gump, Strauss, Hauer & Feld, LLP

(57) ABSTRACT

Bottom edge brackets for an upward acting door each include a base part including fastener receiving bores for securing the brackets to the bottom edge of the door, a flange projecting substantially normal to the base part including a connecting lug mounted for connection to a becket or loop of a door lifting cable and an integral rolled tubular guide roller support portion for supporting the shaft of a door guide roller. Each of the brackets also includes a hook portion projecting from the base part and adapted to be received in an opening formed in the bottom edge of the door for retaining the brackets connected to the door when door lifting forces are being applied thereto if one or more fasteners is loose or removed from the bracket.

11 Claims, 4 Drawing Sheets

BOTTOM BRACKET FOR UPWARD ACTING DOOR

FIELD OF THE INVENTION

The present invention pertains to a combination guide roller support and lifting cable connection bracket for an upward acting door.

BACKGROUND

Upward acting or vertical opening sectional doors, as well as single panel doors, are ubiquitous as both residential and commercial garage doors. One continuing and pressing need in the art of such doors has been to reduce the weight of the door while not sacrificing strength and rigidity and to provide a suitable secure closure over the door opening, such as a garage vehicle entry opening. One problem associated with providing lightweight doors constructed of metal sheet, as well as polymer materials has been the provision of suitable brackets for transferring loads from door counterbalance or lifting cables to the door structure itself and to also provide a suitable guide member support structure for the lowermost guide member for guiding the door for movement between open and closed positions. Such brackets should also be arranged in such a way as to minimize inadvertent disconnection of the bracket from the door when the door counterbalance or lifting cables are under high tension, so as to minimize the chance of injury, damage to the door structure and/or damage to the counterbalance mechanism. It is to these ends that the present invention has been developed.

SUMMARY OF THE INVENTION

The present invention provides an improved bottom edge bracket for a sectional as well as a single panel upward acting door.

In accordance with one aspect of the invention, a door bottom edge bracket is provided for an upward acting door wherein the point of attachment of a counterbalance or door lifting cable, or similar flexible member, to the door is arranged in such a way as to transfer lifting forces to the door in an improved manner and to minimize the chance of unwanted disconnection of the bracket from the door when the door is in a closed position and maximum force is exerted on the bracket and the door lifting cable.

In accordance with another aspect of the invention, a bottom edge bracket is provided for an upward acting door which is particularly adapted for supporting a door guide member, including, in particular, a support shaft for a guide roller.

In accordance with another aspect of the present invention, a bracket is provided for an upward acting door which is particularly adapted for transferring door counterbalance or lifting forces to the door structure while minimizing the concentration of forces acting on the door structure.

Still further, the present invention provides a combined counterbalance cable attachment bracket and guide member support bracket for an upward acting door which is easy to fabricate and reliable in operation.

Those skilled in the art will further appreciate the above-mentioned advantages and superior features of the present invention together with other important aspects thereof upon reading the detailed description which follows in conjunction with the drawing.

DETAILED DESCRIPTION OF A PREFERRED EMBODIMENT

Figure 1:
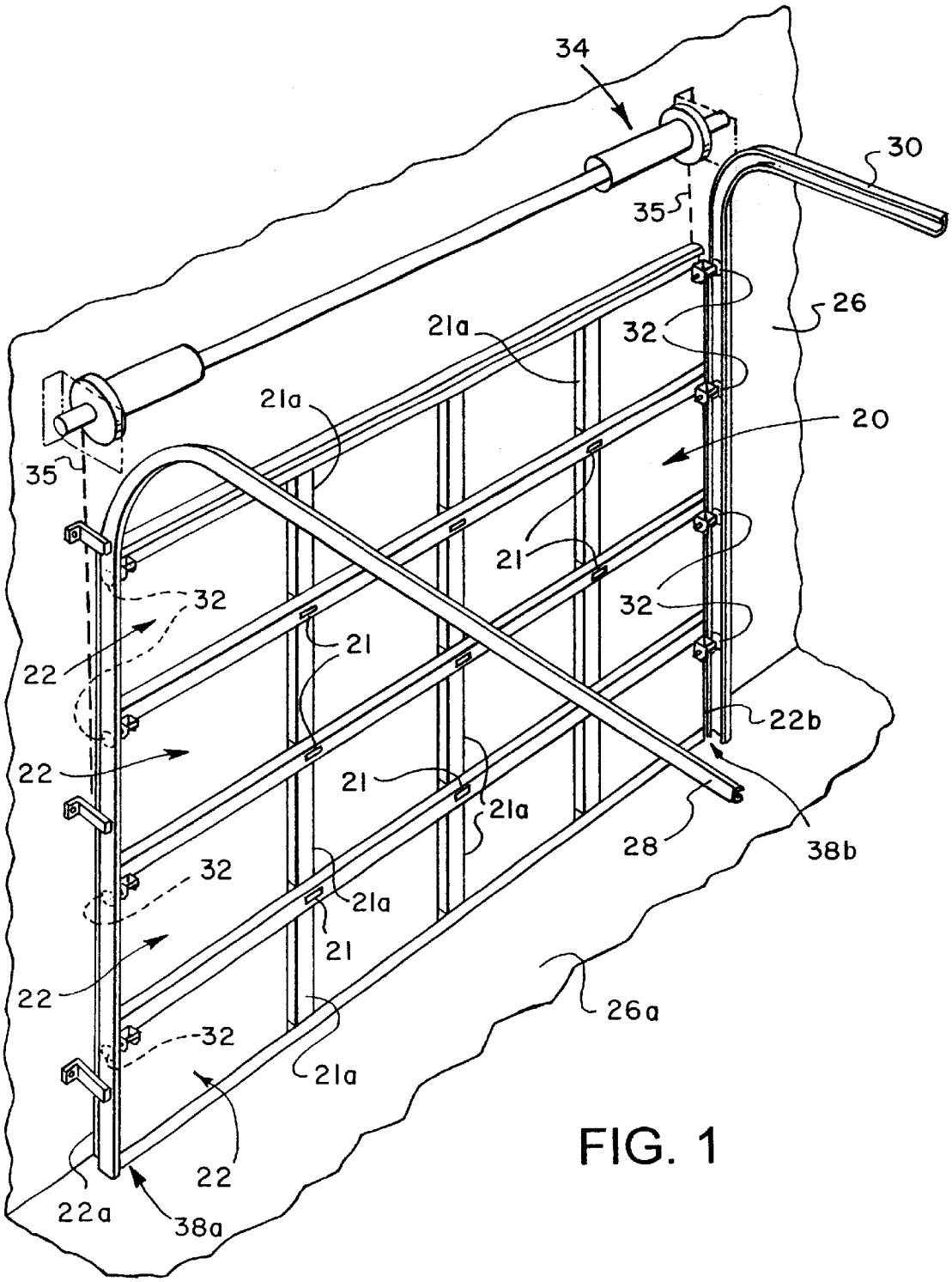
FIG. 1 is a perspective view of a sectional upward acting door including opposed bottom edge brackets in accordance with the invention.

In the description which follows, like parts are marked throughout the specification and drawing with the same reference numerals, respectively. The drawing figures are not necessarily to scale and certain elements may be shown in generalized form in the interest of clarity and conciseness.

Referring to FIG. 1, there is illustrated an upward acting door, generally designated by the numeral 20. The door 20, in one preferred embodiment, comprises a plurality of generally planar door panels 22 which are interconnected by suitable hinge assemblies 21 spaced apart between cooperating longitudinal side edges of the door panels, as illustrated, and aligned with spaced apart vertically extending panel reinforcing members or stiles 21*a*. The door 20 is supported for movement between the closed position shown, which closes an opening in a wall 26, and an open position by spaced apart guide tracks 28 and 30. Opposed roller type guide members 32 are mounted on the door 20 at spaced apart positions and are retained in the guide tracks 28 and 30, respectively, in a known manner for supporting the door in its open and closed positions and for guiding the door during movement therebetween.

A suitable counterbalance mechanism 34 is mounted on wall 26, generally above and adjacent to the door 20 and is connected to the door by spaced apart depending flexible members, such as steel cables 35, also in a generally known manner. A preferred type of counterbalance mechanism 34 is disclosed in U.S. patent application Ser. No. 09/096,663 filed Jun. 12, 1998, incorporated herein by reference and assigned to the assignee on the present invention. Operator mechanism for moving the door 20 between open and closed positions may be of a conventional type, not shown.

Figure 2:
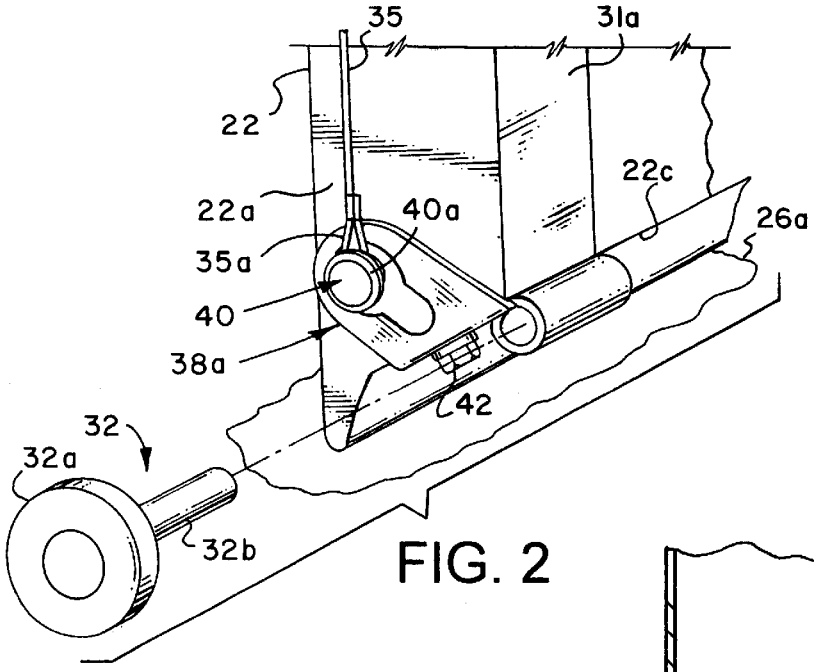
FIG. 2 is a detail exploded perspective view of one of the brackets connected to one side of the lowermost door panel at the bottom edge of the panel for the door shown in FIG. 1.
Figure 4:
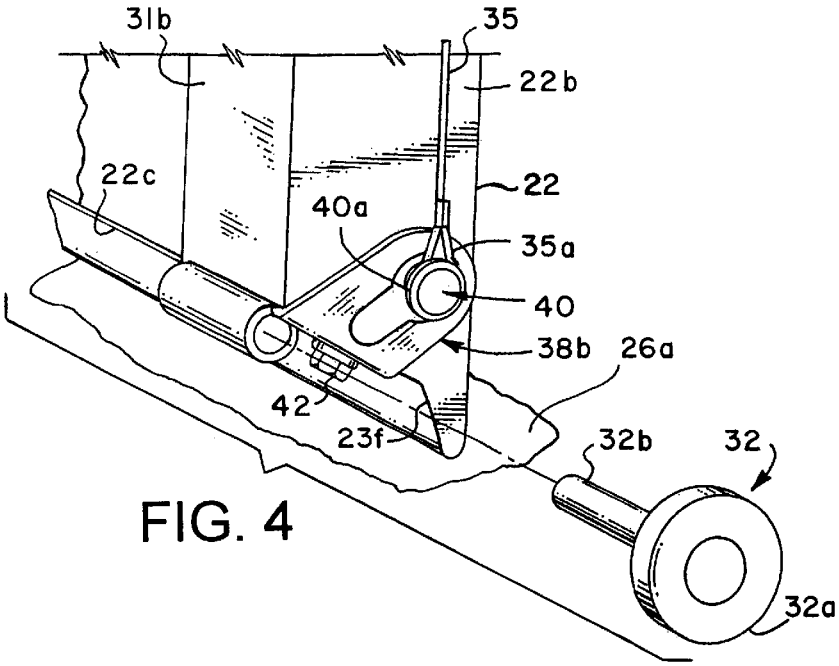
FIG. 4 is an exploded perspective view of the opposite side of the lowermost door panel showing the other of the two bottom edge brackets for the door shown in FIG. 1.
Figure 4A:
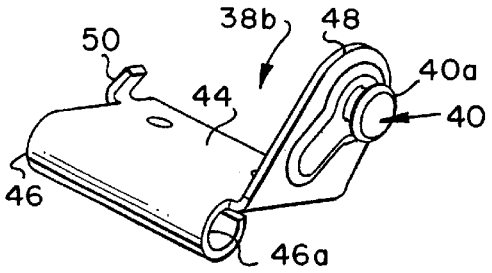
FIG. 4A is a detail perspective view of the bracket shown in FIG. 4 but removed from the door panel.

The depending cables 35 are connected to the lowermost panel 22 at opposite side edges thereof by way of opposed brackets, each generally designated by the numerals 38*a* and 38*b*, see FIGS. 2 and 4, which brackets are each adapted to support a guide member 32. Guide members 32 each comprise rollers 32*a* mounted on elongated generally cylindrical shaft members 32*b* and, preferably, are rotatable with respect thereto by way of suitable bearing means, respectively, not shown. Each of the brackets 38*a* and 38*b* is connected to one of the cables 35, as illustrated in FIGS. 2 and 4. Each of the cables 35 is preferably provided with a becket or eye 35*a* at its free end, which may or may not include a thimble, not shown. Each of the cable beckets 35*a* is adapted to engage a bracket connector part comprising a flanged lug 40 mounted on the respective brackets 38*a* and 38*b*, as shown. Each of the brackets 38*a* and 38*b* is adapted to be secured to an inclined but generally downward facing bottom edge surface 22*c* of the panel 22 by at least two spaced apart hexhead self tapping threaded fasteners 42, one shown in FIGS. 2 and 4, respectively.

Figure 3:
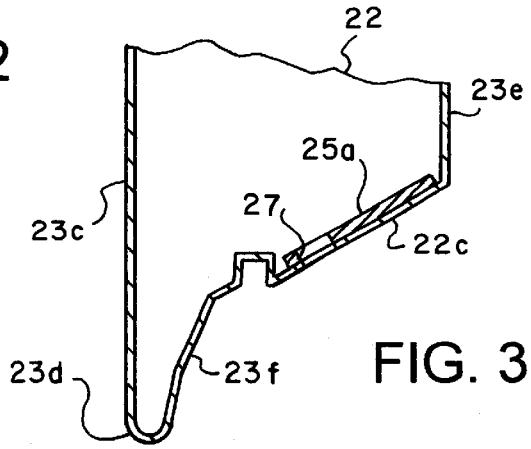
FIG. 3 is a detail transverse section view of the lowermost door panel showing a reinforcing plate and receiving bore for a bracket retainer hook.

Referring briefly to FIG. 3, there is illustrated a detail transverse section view of the lower portion of a panel 22 wherein the panel is constructed of a rolled or extruded sheet of metal or plastic having an outer generally planar panel surface 23*c*, a generally cylindrical curved bottom edge tip 23*d* and an inner panel surface 23*e* joined to the edge tip 23*d* by the inclined surface 22*c* and a generally concave surface 23*f*. Inclined surface 22*c* preferably includes a reinforcing or backing plate 25*a* suitably secured thereto. The section view of FIG. 3 also illustrates an opening 27 extending through the panel sheet which forms the surface 22*c* and the reinforcing plate 25*a*. The purpose of opening 27 will be explained in further detail herein. The configuration of panel 22 shown in FIG. 3 extends across the bottom edge of the panel and openings 27 are disposed at predetermined distances from each of side edges 22*a* and 22*b*. Panel edges 22*a* and 22*b* are further defined by generally L-shaped end stile members of left and right hand configuration, respectively, and designated by numerals 31*a* and 31*b*. In FIGS. 2 and 4, the end stile members 31*a* and 31*b* are shown forming closures over the open side edges of the panel 22, and provide reinforcement and added stiffness for the panel.

Figure 8:
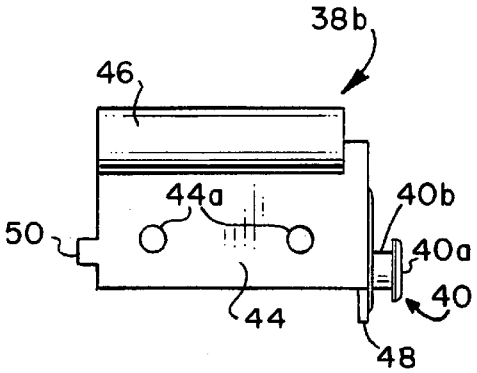
FIG. 8 is a bottom plan view of the bracket shown in FIG. 4A.

Referring now to FIG. 4A through FIG. 8, the so-called right-hand bracket 38*b* is illustrated in detail. The so-called left-hand bracket 38*a* is a substantially identical mirror image of the bracket 38*b*. The bracket 38*b* includes a generally planar and somewhat rectangular base part 44 which is integrally joined to a rolled tubular part 46 including a bore 46*a* for journaling a shaft 32*b* of a guide roller 32. An integral flange 48 projects normal to the plane of the base part 44 at one end thereof. A side edge of the base part 44 opposite the flange 48 includes a retainer comprising a relatively short hook portion 50 which also projects from the plane of the base part 44 at an angle, preferably less than ninety degrees, to form a hook adapted to be received in an opening 27, see FIG. 6, to provide additional retaining means for the bracket 38*b* in the event of either one of the fasteners 42 backing out of or becoming disconnected from the panel 22. As shown in FIG. 8, base part 44 includes two spaced apart bores 44*a* formed therein for receiving the aforementioned fasteners 42. Tubular part 46 extends along base part 44 adjacent bores 44*a*.

Figure 6A:
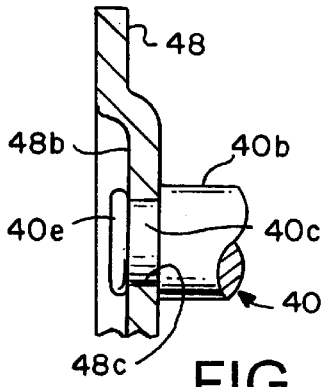
FIG. 6A is a detail view illustrating the manner of attachment of a lug to the bracket shown in FIG. 6.
Figure 5:
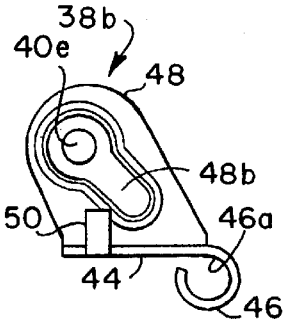
FIG. 5 is a left transverse side elevation of the bracket shown in FIG. 4A.
Figure 6:
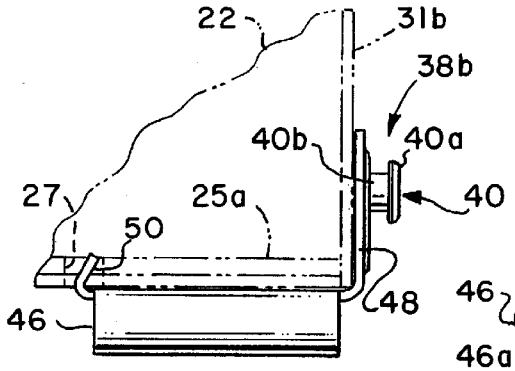
FIG. 6 is a longitudinal side elevation of the bracket shown in FIG. 4A illustrating the bracket retention hook disposed in an opening formed in the bottom edge of the door panel.
Figure 7:
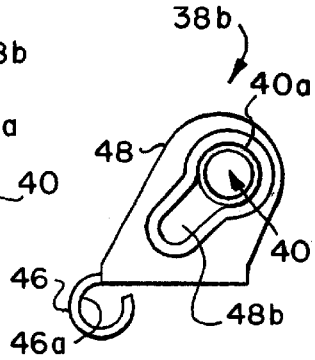
FIG. 7 is a right transverse side elevation of the bracket shown in FIG. 4A.

Referring to FIGS. 6 and 6A, in particular, the flange 48 includes a laterally displaced or coined recess portion 48*b* having a bore 48*c* therein, FIG. 6A, for receiving a shank portion 40*c* of the lug 40, which lug is also configured to include a larger diameter pin portion 40*b* and a circumferential flange 40*a*, see FIG. 6. Shank portion 40*c* projects through the bore 48*c* formed in the coined or displaced portion 48*b* of flange 48 and the lug 40 is riveted to the flange 48 by displacement of part of shank 40*c* as indicated at 40*e*. Accordingly, lug 40 may be characterized as a rivet which is secured only to the flange 48 but forms a connecting pin for connection of the bracket 38*b* to a cable 35, as illustrated in FIG. 4. The flange 48 is laterally displaced at 48*b* to provide added stiffness of the flange and clearance for the rivet portion 40*e* when the bracket 38*b* is mounted on a panel 22, as shown in FIGS. 4 and 6, so that the flange 48 is substantially flush with the side edge 22*b* of the panel as provided by the end stile 31*b*.

The brackets 38*a* and 38*b* provide several advantages in operation in connection with upward acting doors, such as the door 20. By way of example, the bracket 38*b* is easily mounted on the inclined surface 22*c* of the lower panel edge by threaded fasteners and is adapted to be retained connected to the panel in the event one or both of the fasteners 42 is removed accidentally or attempted purposefully. This latter event is minimized since the fasteners 42 face generally downwardly in close proximity to a floor surface such as the floor surface 26*a*, see FIGS. 1, 2 and 4, which minimizes the opportunity to apply a wrench or other tool to remove the fasteners if removal of the bracket 38*a* or 38*b* is attempted with the door 20 in the closed position and cables 35 under maximum tension. Tubular part 46 is also positioned to minimizes access to fasteners 42 in the closed position of door 20. In all events, if the fasteners 42 are removed while there is tension on a cable 35, when connected to one of the brackets 38*a* or 38*b*, the hook or finger 50 will substantially prevent disconnection of the bracket from the door panel. On the other hand, the fasteners 42 are relatively easily accessible when the door 20 is in an open position, under which conditions the tension on the cables 35 is usually somewhat reduced.

Another advantage of the brackets 38*a* and 38*b* is that they also form supports for opposed ones of guide members 32. Still further, the brackets 38*a* and 38*b* serve the purpose of transferring door counterbalance or lifting forces to the panel 22 over a distributed area of the base 44 of the brackets, respectively. The brackets 38*a* and 38*b* are easily fabricated by conventional metal forming techniques including, rolling and coining or stamping operations which may be carried out by so-called progressive die forming methods. The cable support lugs 40 may be attached to the brackets 38*a* and 38*b* in a conventional manner using known rivet or upset forming techniques. Moreover, the brackets 38*a* and 38*b* may be fabricated of conventional materials capable of being worked by the aforementioned methods.

Figure 9:
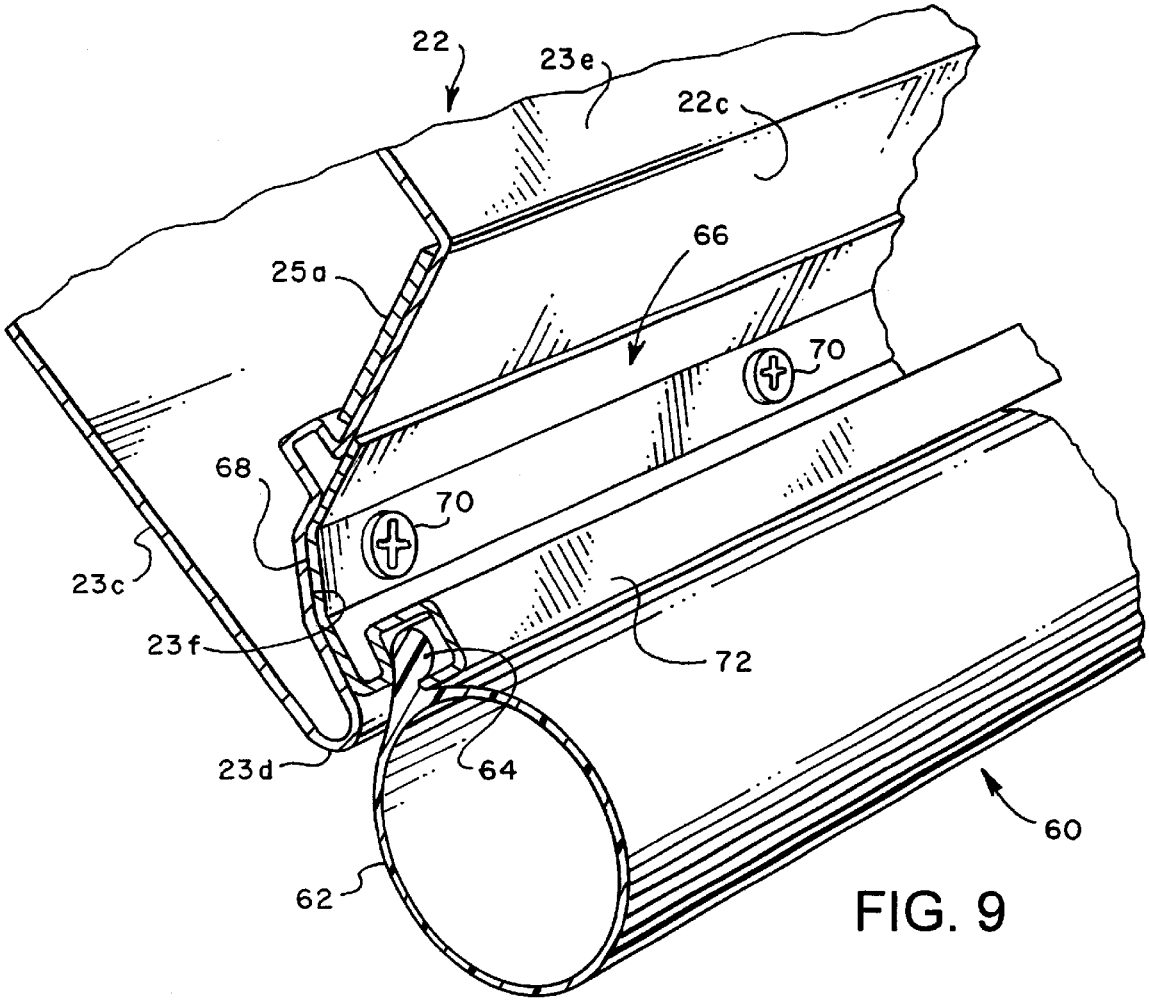
FIG. 9 is a perspective view showing a bottom edge seal and mounting bracket connected to the bottom edge of the door panel.

Referring briefly to FIG. 9, the bottom edge of a door panel 22 is further shown to include a door bottom edge seal assembly 60 including an elongated flexible tubular seal member 62 having an integral retaining boss 64 form thereon and projecting radially from the surface of the tubular seal member 62 outwardly for retention in a slot defined by a formed metal seal retainer plate, generally designated by the numeral 66. Retainer plate 66 includes a flange portion 68 which is shaped to conform to the concave surface 23*f* and is secured to the panel 22 at the surface 23*f* by spaced apart self tapping fasteners 70. Retainer plate 66 further includes an elongated slot forming channel portion 72 which receives the retainer boss 64, as shown. Accordingly, the bottom edge of the bottom panel 22, defined by the surfaces 23*f* and 22*c*, advantageously supports a flexible bottom edge seal as well as the aforementioned brackets 38*a* and 38*b*. The flexible tubular seal member 62 may be formed of a suitable extrudable polymer material, for example. The retainer plate 66 may be a formed or extruded metal or plastic member.

The installation of the brackets 38*a* and 38*b* and the seal assembly 60, as well as the operation of the door 20, is believed to be readily understandable to those of ordinary skill in the art based on the foregoing description. Although a preferred embodiment of the invention has been described in detail, those skilled in the art will recognize that various substitutions and modifications may be made without departing from the scope and spirit of the appended claims.

What is claimed is:

1. In an upward acting door including at least one elongated flexible lifting member for lifting said door from a side edge thereof, a bracket adapted to be connected to a bottom edge of said door which faces generally downwardly toward a floor surface when said door is in a closed position for connecting said door to said lifting member, said bracket comprising:

a base part adapted to be secured to a surface of said bottom edge of said door, said base part including at least one fastener receiving bore formed therein for receiving a threaded fastener for securing said bracket to said bottom edge of said door so as to minimize access to said fastener for removal thereof from said bottom edge of said door in said closed position of said door;

an integral flange part extending at an angle with respect to said base part;

a connector on said flange part for connecting said lifting member to said bracket for transferring lifting forces from said lifting member to said door through said bracket;

a support part on said bracket for supporting a guide member for guiding said door for movement between open and closed positions; and a retainer for engagement with said door and for retaining said bracket connected to said door in the event of removal of said fastener from said bracket and when lifting forces are being applied to said door through said bracket.

2. The invention set forth in claim 1 wherein:

said support part includes an integral tubular portion of said base part formed to provide a bore for receiving a support shaft of said guide member.

3. The invention set forth in claim 2 wherein:

said tubular portion extends along said base part adjacent said at least one bore for receiving said fastener to minimize access to said fastener when said bracket is secured to said bottom edge of said door and said door is in said closed position.

4. In an upward acting door including at least one elongated flexible lifting member for lifting said door from a side edge thereof, a bracket adapted to be connected to a generally downward facing bottom edge of said door for connecting said door to said lifting member, said bracket comprising:

a base part adapted to be secured to a surface of said bottom edge of said door, said base part including at least one fastener receiving bore formed therein for receiving a threaded fastener for securing said bracket to said bottom edge of said door;

an integral flange extending at an angle with respect to said base part;

a connector on said flange for connecting said lifting member to said bracket for transferring lifting forces from said lifting member to said door through said bracket; and a retainer for engagement with said door comprising a hook portion of said base part adapted to project into an opening in said bottom edge of said door to retain said bracket in engagement with said door when lifting forces are applied to said door by said lifting member.

5. The invention set forth in claim 4 including:

a tubular portion for receiving a part of a guide member for said door, said tubular portion extending along said base part adjacent said bore for receiving said one fastener to minimize access to said one fastener when said bracket is secured to said bottom edge of said door.

6. The invention set forth in claim 4 wherein:

said connector comprises a lug including a retaining flange thereon for retaining said lifting member engaged with said lug and a shank part of said lug adapted to project through an opening in said flange of said bracket and to be displaced into forcible engagement with said flange of said bracket for securing said lug to said bracket.

7. In an upward acting door including at least one elongated flexible lifting member for lifting said door from a side edge thereof, a bracket adapted to be connected to a bottom edge of said door which faces generally downwardly toward a floor surface when said door is in a closed position for connecting said door to said lifting member, said bracket comprising:

a base part adapted to be secured to a surface of said bottom edge of said door;

an integral flange part extending at an angle with respect to said base part;

a connector lug supported on said flange part for connecting said lifting member to said bracket for transferring lifting forces from said lifting member to said door through said bracket; and a support part on said bracket for supporting a guide member for guiding said door for movement between open and closed positions, said support part including an elongated integral tubular portion of said base part formed to provide a bore for receiving a support shaft of said guide member and extending along said base part over a major portion of said base part between a side of said base part and said flange part and adjacent at least one fastener receiving bore in said base part to minimize access to a fastener disposed in said fastener receiving bore when said bracket is secured to said bottom edge of said door and said door is in a closed position such that said bottom edge is adjacent a floor surface.

8. The invention set forth in claim 7 including:

a retainer for engagement with said door and for retaining said bracket connected to said door when lifting forces are being applied thereto through said bracket.

9. In an upward acting door including at least one elongated flexible lifting member for lifting said door from a side edge thereof, a bracket adapted to be connected to a generally downward facing bottom edge of said door for connecting said door to said lifting member, said bracket comprising:

a base part adapted to be secured to a surface of said bottom edge of said door;

an integral flange part extending at an angle with respect to said base part;

a connector on said flange part for connecting said lifting member to said bracket for transferring lifting forces from said lifting member to said door through said bracket;

a support part on said bracket for supporting a guide member for guiding said door for movement between open and closed positions; and a retainer for engagement with said door and for retaining said bracket connected to said door when lifting forces are being applied thereto through said bracket, said retainer comprising a hook portion of said base part adapted to project into an opening in said bottom edge of said door to retain said bracket in engagement with said door when lifting forces are applied to said door by said lifting member.

10. In an upward acting door including at least one elongated flexible lifting member for lifting said door from a side edge thereof, a bracket adapted to be connected to a generally downward facing bottom edge of said door for connecting said door to said lifting member, said bracket comprising:

a base part adapted to be secured to a surface of said bottom edge of said door;

an integral flange part extending at an angle with respect to said base part;

a connector on said flange part for connecting said lifting member to said bracket for transferring lifting forces from said lifting member to said door through said bracket, said connector comprising a lug including a retaining flange thereon for retaining said lifting member engaged with said lug and a shank part of said lug adapted to project through an opening in said flange part of said bracket and to be displaced into forcible engagement with said flange part of said bracket for securing said lug to said bracket;

a support part on said bracket for supporting a guide member for guiding said door for movement between open and closed positions; and a retainer for engagement with said door and for retaining said bracket connected to said door when lifting forces are being applied thereto through said bracket.

11. In an upward acting door including at least one elongated flexible lifting member for lifting said door from a side edge thereof, a bracket adapted to be connected to a generally downward facing bottom edge of said door for connecting said door to said lifting member, said bracket comprising:

a base part adapted to be secured to a surface of said bottom edge of said door;

an integral flange part extending at an angle with respect to said base part;

a connector lug supported on said flange part for connecting said lifting member to said bracket for transferring lifting forces from said lifting member to said door through said bracket, said lug including a retaining flange thereon for retaining said lifting member engaged with said lug and a shank part adapted to project through an opening in said flange part of said bracket and to be displaced into forcible engagement with said flange part of said bracket for securing said lug to said bracket; and a support part on said bracket for supporting a guide member for guiding said door for movement between open and closed positions, said support part including an integral tubular portion of said base part formed to provide a bore for receiving a support shaft of said guide member and extending along said base part adjacent at least one fastener receiving bore in said base part to minimize access to a fastener disposed in said fastener receiving bore when said bracket is secured to said bottom edge of said door and said door is in a closed position such that said bottom edge is adjacent a floor surface.

* * * * *